US010563552B2

(12) United States Patent
Biasin et al.

(10) Patent No.: US 10,563,552 B2
(45) Date of Patent: Feb. 18, 2020

(54) OIL PAN ASSEMBLY

(71) Applicant: GM GLOBAL TECHNOLOGY OPERATIONS LLC, Detroit, MI (US)

(72) Inventors: Valter Biasin, Turin (IT); Tiberiu Vasilcin, Turin (IT); Giuseppe Credo, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 234 days.

(21) Appl. No.: 15/622,528

(22) Filed: Jun. 14, 2017

(65) Prior Publication Data

US 2018/0363521 A1 Dec. 20, 2018

(51) Int. Cl.
*F01M 11/00* (2006.01)

(52) U.S. Cl.
CPC . *F01M 11/0004* (2013.01); *F01M 2011/0008* (2013.01); *F01M 2011/0054* (2013.01); *F01M 2011/0062* (2013.01)

(58) Field of Classification Search
CPC ..... F01M 2011/0008; F01M 11/00
USPC ..... 184/106
See application file for complete search history.

(56) References Cited

U.S. PATENT DOCUMENTS

| | | | | |
|---|---|---|---|---|
| 3,653,464 | A | 4/1972 | Jacobsen et al. | |
| 3,695,386 | A * | 10/1972 | Thien | F02B 77/13 123/195 C |
| 4,223,073 | A * | 9/1980 | Caldwell | B32B 15/06 428/422 |
| 4,522,165 | A | 6/1985 | Ogawa | |
| 5,531,196 | A * | 7/1996 | Clark | F01M 11/0004 123/195 C |
| 7,509,935 | B2 * | 3/2009 | Vincer | F01M 11/0004 123/195 C |
| 2004/0154576 | A1 * | 8/2004 | Kamiyama | F01M 11/0004 123/195 C |
| 2007/0221448 | A1 * | 9/2007 | Kudo | C08L 57/04 184/106 |
| 2009/0145395 | A1 * | 6/2009 | Ishii | F01M 11/0004 123/195 C |
| 2010/0229821 | A1 * | 9/2010 | Decker | B29C 45/00 123/195 C |
| 2012/0067322 | A1 * | 3/2012 | Andersson | F01M 11/0004 123/198 E |
| 2015/0114955 | A1 * | 4/2015 | Inaba | H02G 3/12 220/3.92 |

* cited by examiner

*Primary Examiner* — Michael R Mansen
*Assistant Examiner* — Mark K Buse
(74) *Attorney, Agent, or Firm* — Cantor Colburn LLP

(57) ABSTRACT

An oil pan assembly for a vehicle engine includes an oil pan having a sectioned base, a sidewall, and a peripheral flange operatively configured to be coupled to an engine block; and a plurality of openings in the oil pan operatively configured to attach the oil plan to an engine block via a plurality of corresponding fasteners.

8 Claims, 5 Drawing Sheets

OIL PAN ASSEMBLY

TECHNICAL FIELD

The present disclosure relates generally to vehicle engines, and in particular, an oil pan arrangement used in vehicle engines.

BACKGROUND

In a traditional oil pan arrangement for a vehicle, the oil pan is typically mounted on the engine block with an RTV layer situated in the joint between the oil pan and the engine block. The RTV layer functions to seal the joint between the oil pan and the engine block under all loading—mechanical, thermal, and dynamic loading. Therefore, the RTV layer further functions to maintain the seal between the oil pan and the engine block even where there is relative movement between the oil pan and the engine block. Under this traditional arrangement, normal opening and lateral slip between the components due to differential thermal expansion/contraction or mechanical loads may occur. Such movement may cause some noise and vibration.

Bolts are typically spaced along the oil pan (proximate to the perimeter of the oil pan) in order to mount the oil pan to the engine block. However, despite the RTV layer and the use of bolts/nuts about the perimeter of the oil, a traditional oil pan still experiences movement relative to the engine block which further serves to strain the RTV layer seal between the oil pan and the engine block.

Accordingly, there is a need to better reduce the relative movement between the oil pan and the engine block to reduce the motion, vibration and noise in the vehicle.

SUMMARY

Accordingly, the present disclosure provides an oil pan assembly for a vehicle engine which reduces vibration in a vehicle due to subsections in the oil pan assembly which are each operatively configured to cancel the vibration and oscillation from a corresponding subsection in the oil pan. The oil pan assembly includes an oil pan having a sectioned base, a sidewall, and a peripheral flange operatively configured to be coupled to an engine block; and a plurality of openings in the oil pan operatively configured to attach the oil plan to an engine block via a plurality of corresponding fasteners.

It is understood that the aforementioned sectioned base of the oil pan is operatively configured cancel noise and vibration that occurs in the oil pan due to the engine or movement of the vehicle. The sectioned base may include a plurality of subsections that are even in number. Each subsection in the plurality of subsections may, but not necessarily, be adjacent to one another. Moreover, each subsection in the plurality of subsections may be operatively configured to cancel oscillation and vibration from a corresponding subsection in the plurality of subsections.

It is also understood that the plurality of subsections may be formed via a plurality of apertures defined in the base of the oil pan, and each aperture in the plurality of apertures may be filled with a flexible seal. Each aperture in the plurality of apertures may, but not necessarily, be in the form of an elongated slot. However, each elongated slot, like any aperture in the plurality of apertures may be filled with a flexible seal.

In yet another embodiment of the present disclosure, an oil pan assembly for a vehicle engine may include an oil pan having a sectioned region and a peripheral flange, the sectioned region being at least one of a base and a sidewall defined by the oil pan. The oil pan may further define a plurality of openings in the peripheral flange which are operatively configured to attach the oil plan to an engine block via a plurality of corresponding fasteners. It is understood that the sectioned region of the oil pan may be operatively configured cancel noise and vibration in the oil pan. The sectioned region further includes a plurality of subsections that are even in number. Each subsection in the plurality of subsections may, but not necessarily, be adjacent to one another. Each subsection in the plurality of subsections is operatively configured to cancel oscillation and vibration from a corresponding subsection in the plurality of subsections.

The plurality of subsections may be formed via a plurality of apertures wherein each aperture in the plurality of apertures is filled with a flexible seal. Each aperture in the plurality of apertures may, but not necessarily be configured as an elongated slot such that each elongated slot is filled with a flexible seal.

The present disclosure and its particular features and advantages will become more apparent from the following detailed description considered with reference to the accompanying drawings.

BRIEF DESCRIPTION OF THE DRAWINGS

These and other features and advantages of the present disclosure will be apparent from the following detailed description, best mode, claims, and accompanying drawings in which:

Like reference numerals refer to like parts throughout the description of several views of the drawings.

DETAILED DESCRIPTION

Figures 1A, 1B, 1C:
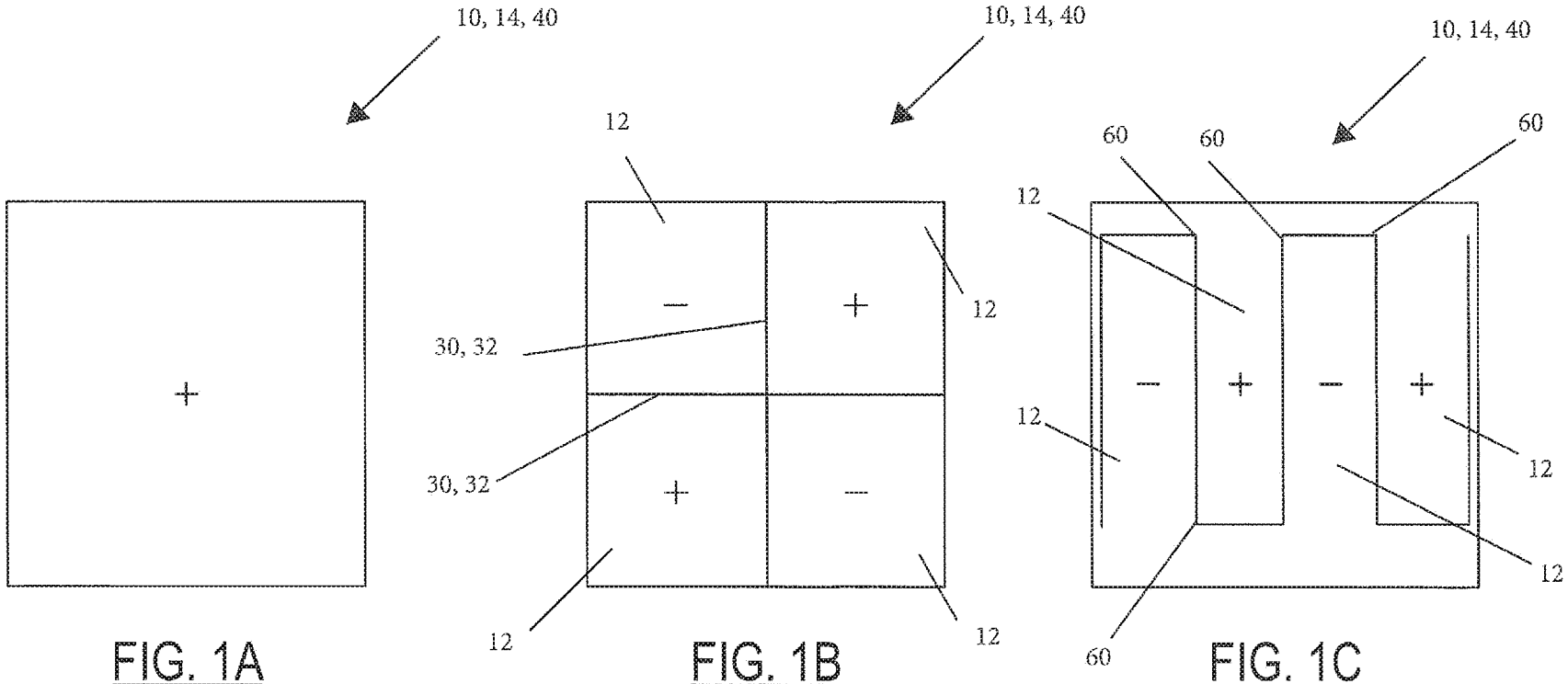
FIG. 1A illustrates a schematic view of a region of an oil pan wherein the region may, but not necessarily be either a sidewall or a base of the oil pan.
FIG. 1B illustrates an example, non-limiting schematic view of the region of an oil pan in FIG. 1A having four subsections.
FIG. 1C illustrates another, example, non-limiting schematic view of the region of an oil pan in FIG. 1A having four subsections.

Reference will now be made in detail to presently preferred compositions, embodiments and methods of the present disclosure, which constitute the best modes of practicing the present disclosure presently known to the inventors. The figures are not necessarily to scale. However, it is to be understood that the disclosed embodiments are merely exemplary of the present disclosure that may be embodied in various and alternative forms. Therefore, specific details disclosed herein are not to be interpreted as limiting, but merely as a representative basis for any aspect of the present disclosure and/or as a representative basis for teaching one skilled in the art to variously employ the present disclosure.

Except in the examples, or where otherwise expressly indicated, all numerical quantities in this description indicating amounts of material or conditions of reaction and/or use are to be understood as modified by the word "about" in describing the broadest scope of the present disclosure. Practice within the numerical limits stated is generally preferred. Also, unless expressly stated to the contrary: percent, "parts of," and ratio values are by weight; the description of a group or class of materials as suitable or preferred for a given purpose in connection with the present disclosure implies that mixtures of any two or more of the members of the group or class are equally suitable or preferred; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this present disclosure is not limited to the specific embodiments and methods described below, as specific components and/or conditions may, of course, vary. Furthermore, the terminology used herein is used only for the purpose of describing particular embodiments of the present disclosure and is not intended to be limiting in any manner.

It must also be noted that, as used in the specification and the appended claims, the singular form "a," "an," and "the" comprise plural referents unless the context clearly indicates otherwise. For example, reference to a component in the singular is intended to comprise a plurality of components.

The term "comprising" is synonymous with "including," "having," "containing," or "characterized by." These terms are inclusive and open-ended and do not exclude additional, unrecited elements or method steps.

The phrase "consisting of" excludes any element, step, or ingredient not specified in the claim. When this phrase appears in a clause of the body of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

The terms "comprising", "consisting of", and "consisting essentially of" can be alternatively used. Where one of these three terms is used, the presently disclosed and claimed subject matter can include the use of either of the other two terms.

Throughout this application, where publications are referenced, the disclosures of these publications in their entireties are hereby incorporated by reference into this application to more fully describe the state of the art to which this present disclosure pertains.

The following detailed description is merely exemplary in nature and is not intended to limit the present disclosure or the application and uses of the present disclosure. Furthermore, there is no intention to be bound by any theory presented in the preceding background or the following detailed description.

The present disclosure provides a solution for reducing movement as well as noise and vibration in the oil pan assembly 10 for a vehicle. The oil pan assembly 10 may be made from any material, such as but not limited to a metal and/or a polymeric material. It is also understood that such movement, noise and vibration may be due to dynamic excitation of the engine (26 in FIG. 5). Accordingly, an oil pan assembly 10 for a vehicle engine 26 is provided which reduces vibration in a vehicle due to subsections 12 in the oil pan assembly 10 which are each operatively configured to cancel the vibration and oscillation from a corresponding subsection 12 in the oil pan 14. The oil pan assembly 10 includes an oil pan having a sectioned base, a sidewall 18, and a peripheral flange 20 operatively configured to be coupled to an engine block 27; and a plurality of openings 22 in the oil pan 14 operatively configured to attach the oil pan 14 to an engine block 27 via a plurality of corresponding fasteners.

It is understood that the aforementioned sectioned base of the oil pan 14 is operatively configured to cancel noise and vibration that occurs in the oil pan 14 due to the engine or movement of the vehicle. The sectioned base may include a plurality of subsections 12 that are even in number. Each subsection in the plurality of subsections 12 may, but not necessarily, be adjacent to one another. Moreover, each subsection in the plurality of subsections (shown as example element 12 in FIG. 3A) may be operatively configured to cancel oscillation and vibration from a corresponding subsection in the plurality of subsections 12.

Figure 2:
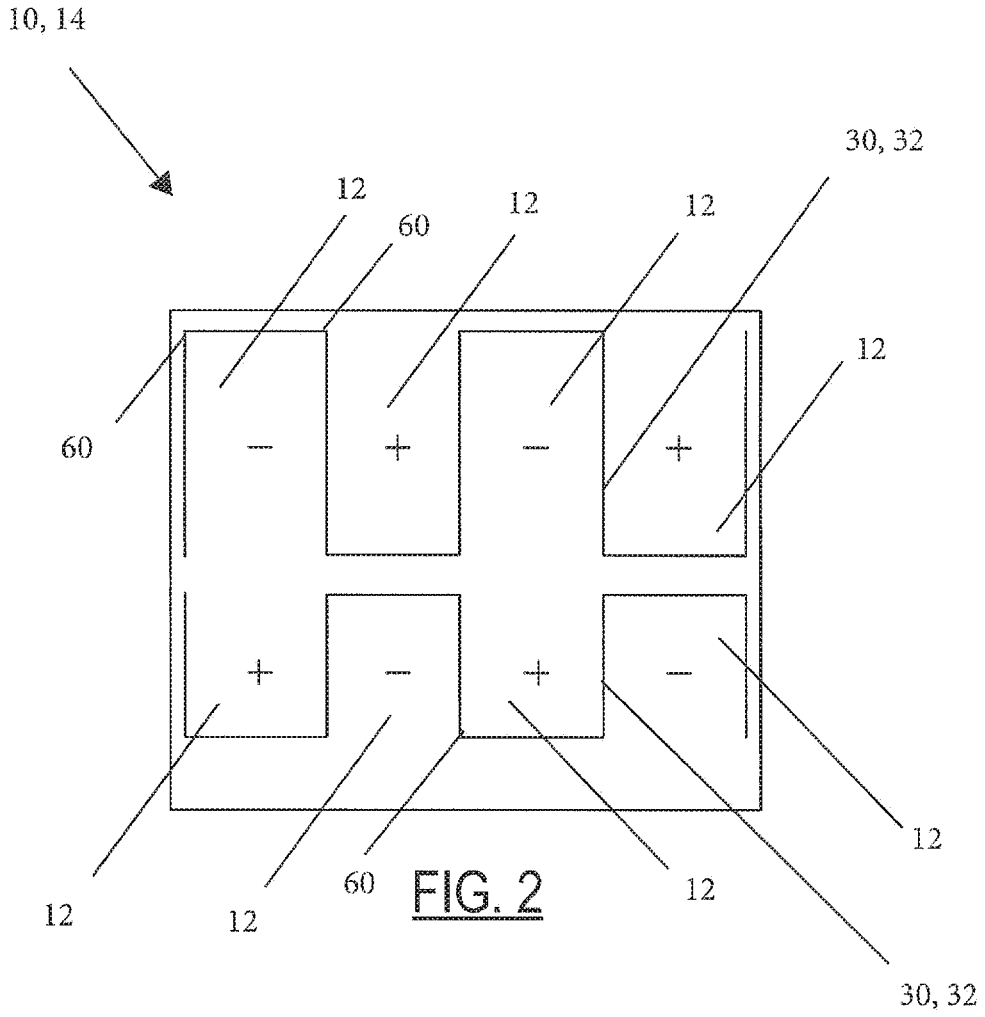
FIG. 2 illustrates an example, non-limiting schematic view of the region of an oil pan in FIG. 1A which has been sub-sectioned into eight subsections.

As shown in FIG. 1A, a schematic view of a region 40 of the oil pan 14 wherein the region 40 may, but not necessarily be either a sidewall or a base of the oil pan 14. Referring now additionally to FIG. 1B, an example, non-limiting schematic view of the region 40 of the oil pan 14 of FIG. 1A is shown wherein the base or region 40 has four subsections 12. FIG. 1C illustrates another example, non-limiting schematic view of the region 40 of the oil pan 14 of FIG. 1A having four subsections 12. FIG. 2 illustrates an example, non-limiting schematic view of the region 40 of the oil pan 14 of FIG. 1A which has been sub-sectioned into eight subsections 12.

Figure 3B:
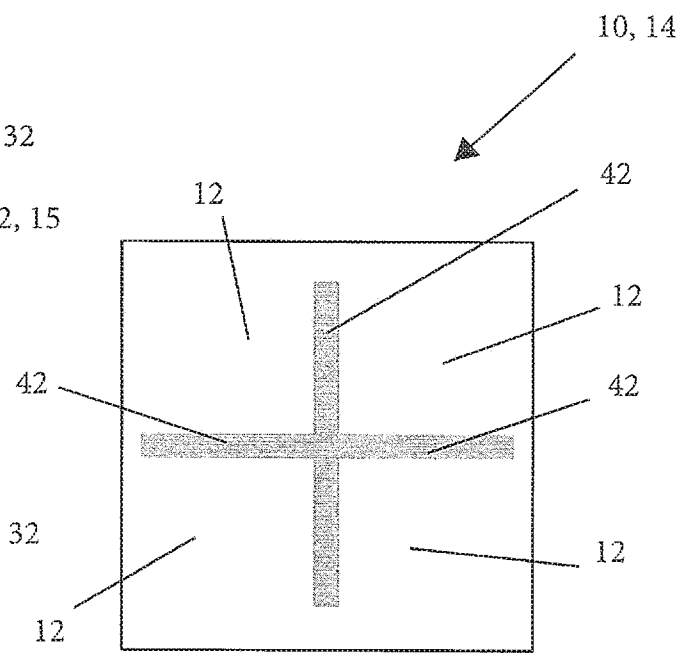
FIG. 3B illustrates an example, non-limiting schematic view of the region of an oil pan in FIG. 3A after the apertures are filled with a flexible seal.
Figure 3A:
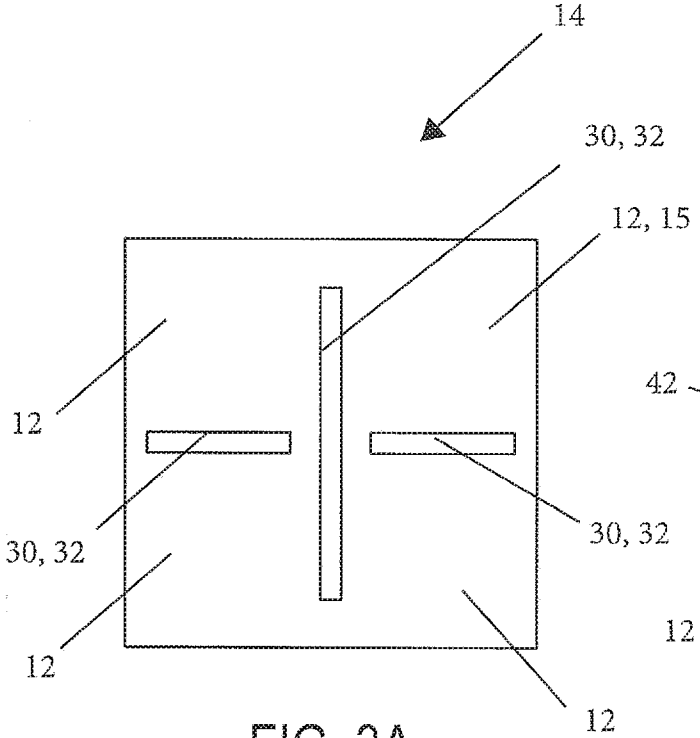
FIG. 3A illustrates an example, non-limiting schematic view of the region of an oil pan in FIG. 1B wherein the subsections are defined by a plurality of apertures.

It is understood that the plurality of subsections 12 may be formed via a plurality of apertures 30 defined in the region 40 (base or side wall for example) of the oil pan 14. The apertures 30 are shown in FIG. 3A. However, it is understood that each aperture 30 in the plurality of apertures 30 may be filled with a flexible seal 42 as shown in FIG. 3B. Referring back to FIG. 3A, each aperture 30 in the plurality of apertures 30 may, but not necessarily, be in the form of an elongated slot 32. However, each elongated slot 32, like any aperture 30 in the plurality of apertures 30 may be filled with a flexible seal 42. As shown in FIGS. 1C and 2, the aperture 30 may be elongated, continuous and have multiple bends 60 in the aperture 30. As shown in FIG. 3A, multiple apertures 30 may be implemented in lieu of an aperture 30 with multiple bends 60.

Figure 5:
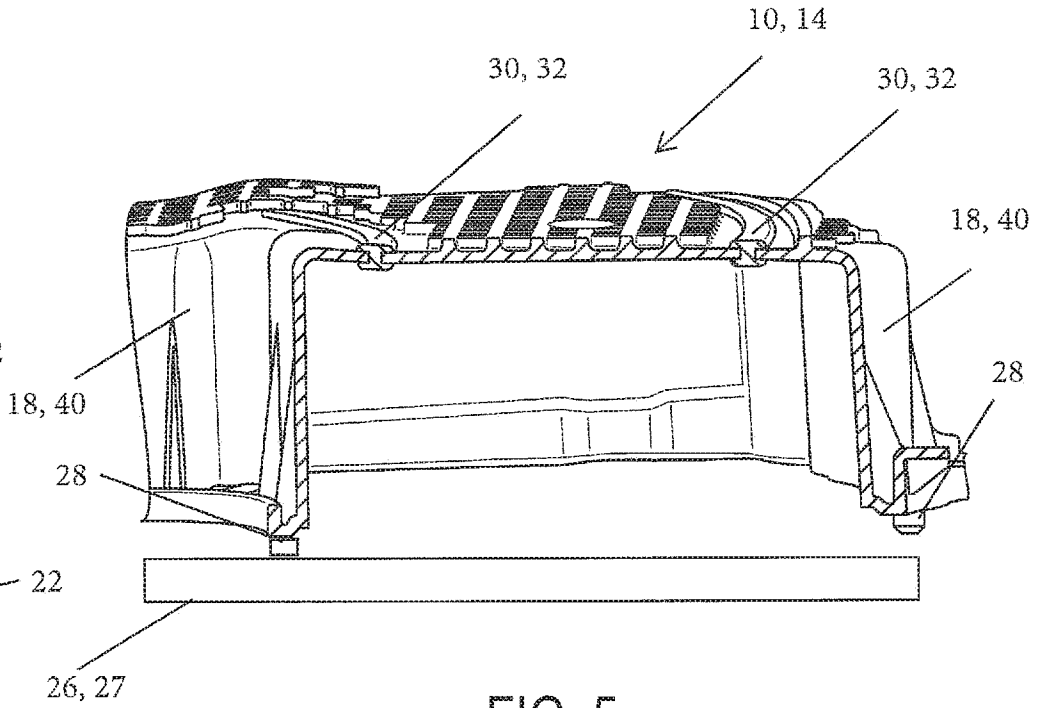
FIG. 5 illustrates a cross-section of the oil pan in FIG. 4 across line 5-5.
Figure 4:
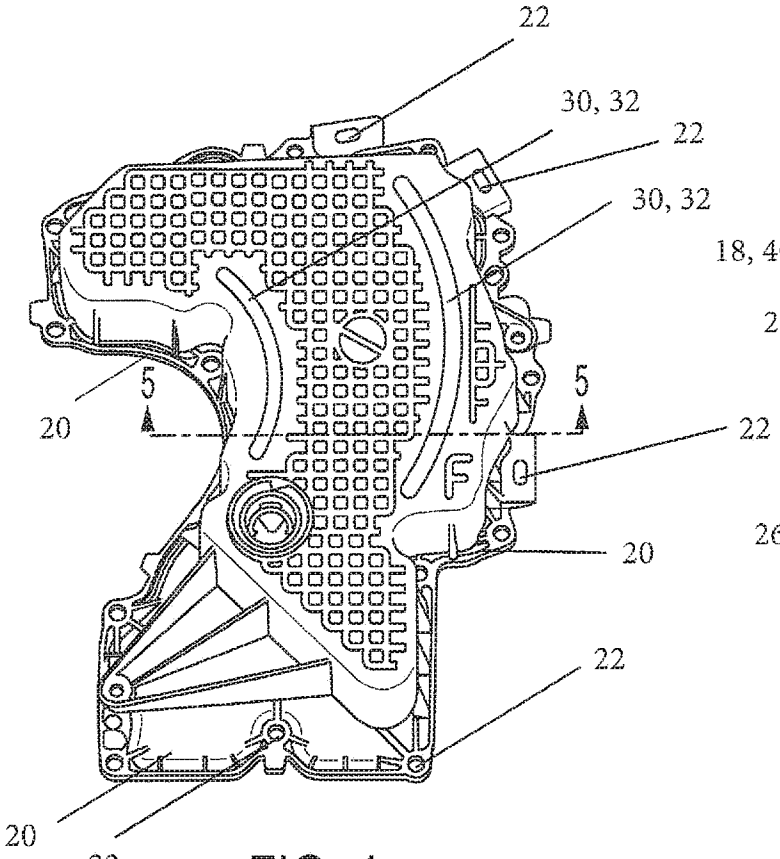
FIG. 4 illustrates a plan view of an oil pan.

In yet another embodiment of the present disclosure, an oil pan assembly 10 for a vehicle engine may include an oil pan having a sectioned region and a peripheral flange. The sectioned region may be at least one of a base and a sidewall defined by the oil pan as shown in FIGS. 4 and 5. The oil pan may further define a plurality of openings 22 in the peripheral flange which are operatively configured to attach the oil plan to an engine block 27 via a plurality of corresponding fasteners. It is understood that the sectioned region of the oil pan may be operatively configured to cancel noise and vibration in the oil pan. The sectioned region further includes a plurality of subsections 12 that are even in number. Each subsection in the plurality of subsections 12 may, but not necessarily, be adjacent to one another. Each subsection in the plurality of subsections 12 is operatively configured to cancel oscillation and vibration from a corresponding subsection 12 in the plurality of subsections 12.

Figure 6:
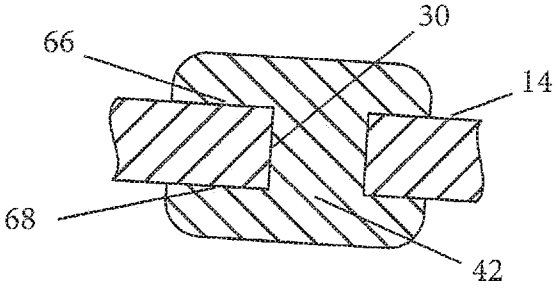
FIG. 6 illustrates an enlarged view of the flexible seal and aperture in FIG. 5.

Similar to that shown in FIGS. 3A-3B, the plurality of subsections 12 may be formed via a plurality of apertures 30 wherein each aperture 30 in the plurality of apertures 30 is filled with a flexible seal 42 as shown in FIGS. 5 and 6. Each aperture 30 in the plurality of apertures 30 may, but not necessarily, be configured as an elongated slot 32 such that each elongated slot 32 is filled with a flexible seal 42. In one example as shown in FIGS. 4 and 5, the plurality of apertures 30 may include two elongated slots 32. One of the two elongated slots 32 may define a radius having a dimension value less than a dimension value of a radius defined by the other of the two elongated slots. The two elongated slots 32 may be arranged with one another to define a non-discrete panel therebetween. Regardless, as shown in FIG. 6, the flexible seal 42 fills the aperture 30 and may extend above and below each aperture 30 such that flexible seal 42 covers a top surface 66 of the oil pan as well as a bottom surface 68 of the oil pan. The flexible seal 42 is operatively configured to allow each subsection 12 to move relative to the adjacent subsection 12 thereby cancelling overall vibration and/or oscillation in the oil pan assembly 10. However, each flexible seal 42 also prevents fluid from passing through each aperture 30.

Figure 7:
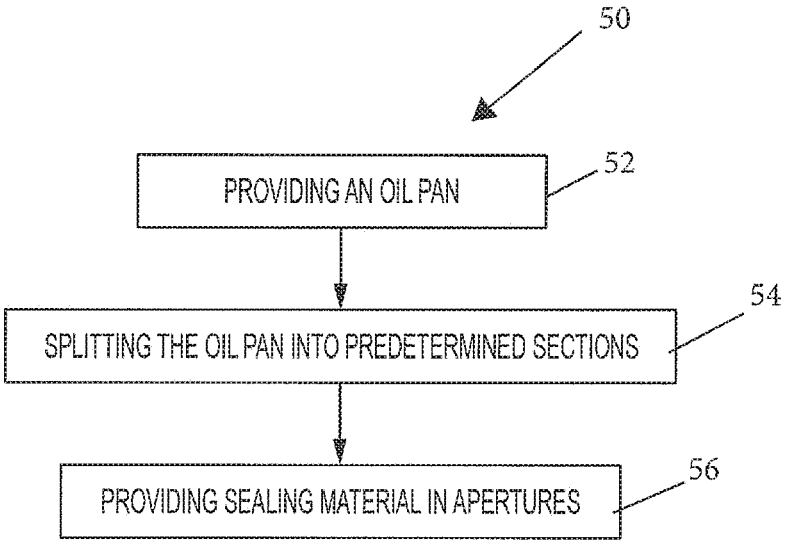
FIG. 7 illustrates a flow chart method of manufacturing the oil pan assembly of the present disclosure.

Referring to FIG. 7, the method for manufacturing the oil assembly of the present disclosure includes the steps of: (1) providing an oil pan in step 52; (2) sectioning the oil pan into predetermined sections via a plurality of predetermined apertures in step 54; and (3) providing a flexible seal in the plurality of apertures in step 56.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An oil pan assembly for a vehicle engine comprising:

an oil pan having a sectioned base, a sidewall, and a peripheral flange operatively configured to be coupled to an engine block; and a plurality of openings in the oil pan operatively configured to attach the oil pan to the engine block via a plurality of corresponding fasteners; and a plurality of apertures including at least a first arc aperture and a second arc aperture, the first arc aperture defining a radius having a dimension value less than a dimension value of a radius of the second arc aperture, wherein the first arc aperture and the second arc aperture are arranged with one another to define a non-discrete panel of the oil pan therebetween.

2. The oil pan assembly of claim 1, wherein each aperture in the plurality of apertures is fitted with a flexible seal.

3. The oil pan assembly of claim 1, wherein each aperture in the plurality of apertures is an elongated slot.

4. The oil pan assembly of claim 3, wherein each elongated slot is filled with a flexible seal.

5. An oil pan assembly for a vehicle engine comprising:

an oil pan having a sectioned region and a peripheral flange, the sectioned region being at least one of a base and a sidewall defined by the oil pan; and a plurality of openings in the peripheral flange of the oil pan operatively configured to attach the oil plan to an engine block via a plurality of corresponding fasteners; and a plurality of apertures in the sectioned region including at least a first arc aperture and a second arc aperture, the first arc aperture defining a radius having a dimension value less than a dimension value of a radius of the second arc aperture, wherein the first arc aperture and the second arc aperture are arranged with one another to define a non-discrete panel of the oil pan therebetween.

6. The oil pan assembly of claim 5, wherein each aperture in the plurality of apertures is filled with a flexible seal.

7. The oil pan assembly of claim 5, wherein each aperture in the plurality of apertures is an elongated slot.

8. The oil pan assembly of claim 7, wherein each elongated slot is filled with a flexible seal.

* * * * *